US007581731B2

(12) United States Patent
Moody et al.

(10) Patent No.: US 7,581,731 B2
(45) Date of Patent: Sep. 1, 2009

(54) THIRTY-ONE/FORTY CARD GAME

(76) Inventors: Ernest W Moody, 2116 Red Bird Dr., Las Vegas, NV (US) 89134; Michael W Wood, 1106 Willow Brook Ave., Denham Springs, LA (US) 70726

( * ) Notice: Subject to any disclaimer, the term of this patent is extended or adjusted under 35 U.S.C. 154(b) by 0 days.

(21) Appl. No.: 11/879,385

(22) Filed: Jul. 16, 2007

(65) Prior Publication Data

US 2009/0020952 A1 Jan. 22, 2009

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 5,362,064 A * 11/1994 Lofink et al. ..... 273/292
6,371,484 B1 * 4/2002 Yuan ..... 273/292
6,422,563 B1 * 7/2002 Fairchild et al. ..... 273/274
7,032,902 B1 * 4/2006 Yuan ..... 273/274
7,210,684 B2 * 5/2007 Yuan ..... 273/292
7,285,048 B2 * 10/2007 Karmarkar ..... 463/42

OTHER PUBLICATIONS

Wikipedia reference, Trente et Quarante at http://en.wikipedia.org/wiki/Trente_et_Quarante, 2 pages.

* cited by examiner

*Primary Examiner*—Gene Kim
*Assistant Examiner*—Dolores Collins
(74) *Attorney, Agent, or Firm*—John Edward Roethel

(57) ABSTRACT

Each bettor wagers on a first hand (the RED hand) or a second hand (the BLACK hand). The first hand is dealt until the count value is at least 31 and not more than 40. The second hand is dealt until the count value is at least 31 and not more than 40. The higher hand wins. Ties are pushes. Aces count one, face cards count ten and all other cards count their pip value.

8 Claims, 3 Drawing Sheets

THIRTY-ONE/FORTY CARD GAME

This invention relates primarily to card games, and more particularly to card games in which the bettor wagers on which of two hands will have a count of closest to forty.

BACKGROUND OF THE INVENTION

As played in most gaming casinos presently, conventional Twenty-One involves a game of chance between a dealer and one or more players. The object is for the player to achieve a numerical count of his hand closer to 21 than the final numerical count of the hand of the dealer; but if the numerical count of the player's hand goes over 21 then the player loses regardless of the final numerical count of the dealer's hand. Aces count one or eleven, face cards count ten and all other cards count their pip value.

Baccarat is also a card counting game. Each bettor wagers on either a Player hand or a Bank hand. In Baccarat, Ten's and face cards count zero, Aces count one and all other cards count their pip value. The count value of a hand is determined by the sum of all cards modulo 10. Simply, when the total value of cards in a hand equals or exceeds ten, the tens digit is dropped. The worst hand having a count value of zero is called a "Baccarat". The best hand has a count value of 9. The highest hand wins.

SUMMARY OF THE INVENTION

The game of the present invention is another card counting game. Each bettor wagers on a first hand (the RED hand) or a second hand (the BLACK hand). The first hand is dealt until the count value is at least 31 and not more than 40. The second hand is dealt until the count value is at least 31 and not more than 40. The higher hand wins. Ties are pushes. Aces count one, face cards count ten and all other cards count their pip value.

DETAILED DESCRIPTION OF THE PREFERRED EMBODIMENTS

Figure 1:
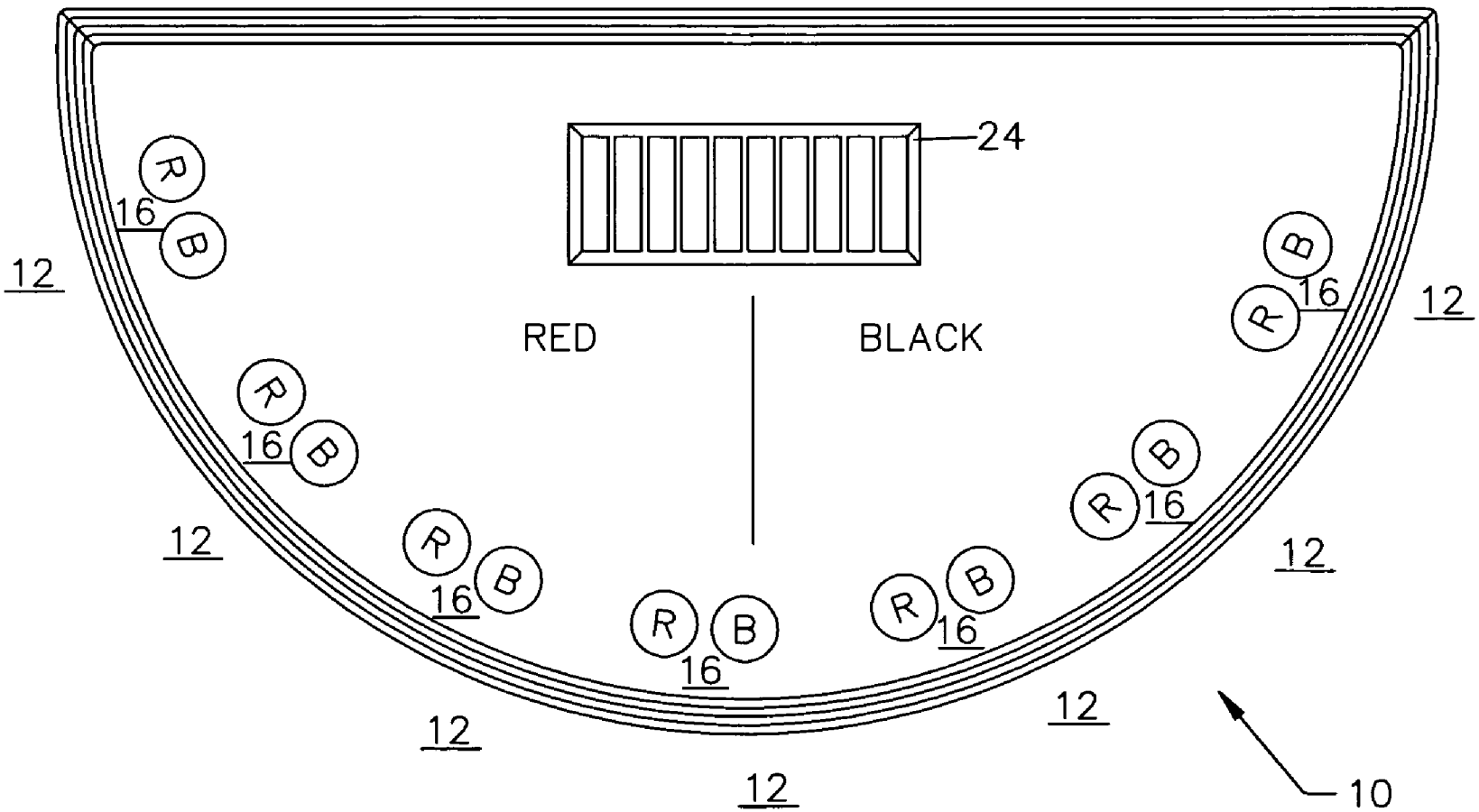
FIG. 1 shows a representative gaming table used in the method of play of the present invention prior to the initial deal of the cards.

The method of the present invention can be played on any suitable gaming table such as the gaming table shown in FIG. 1 at 10. A plurality of bettor locations 12 are positioned around the gaming table 10 like at a conventional Twenty-One table. Each bettor location 12 has a wagering location 16 at which a bettor may wager on either the first RED hand in the R circle or on the second BLACK hand in the B circle. A dealer is positioned adjacent the chip rack 24 like at a conventional Twenty-One table. In the center of the gaming table 10, there is provided a RED location for displaying the cards dealt for the first RED hand and a BLACK location for displaying the cards dealt for the second BLACK hand.

In the method of play of the present invention, each bettor wagers on a first hand (the RED hand) or a second hand (the BLACK hand).

The method of play is preferably dealt using a physical standard deck of fifty-two playing cards. The dealer shuffles the deck and begins the deal of the game after all bettors have made a wager.

In a preferred embodiment, the dealer displays the first hand, the RED hand. A card is displayed from the deck. However, the first card dealt to the first hand must be a red card (a Diamond or Heart). Any black card (a Club or Spade) that comes off the deck before the first black card is discarded. After the first red card is dealt into the first hand, cards are then dealt into the first hand regardless of suit.

The first hand is dealt until the count value is at least 31 and not more than 40. Aces count one, face cards count ten and all other cards count their pip value.

Figure 2:
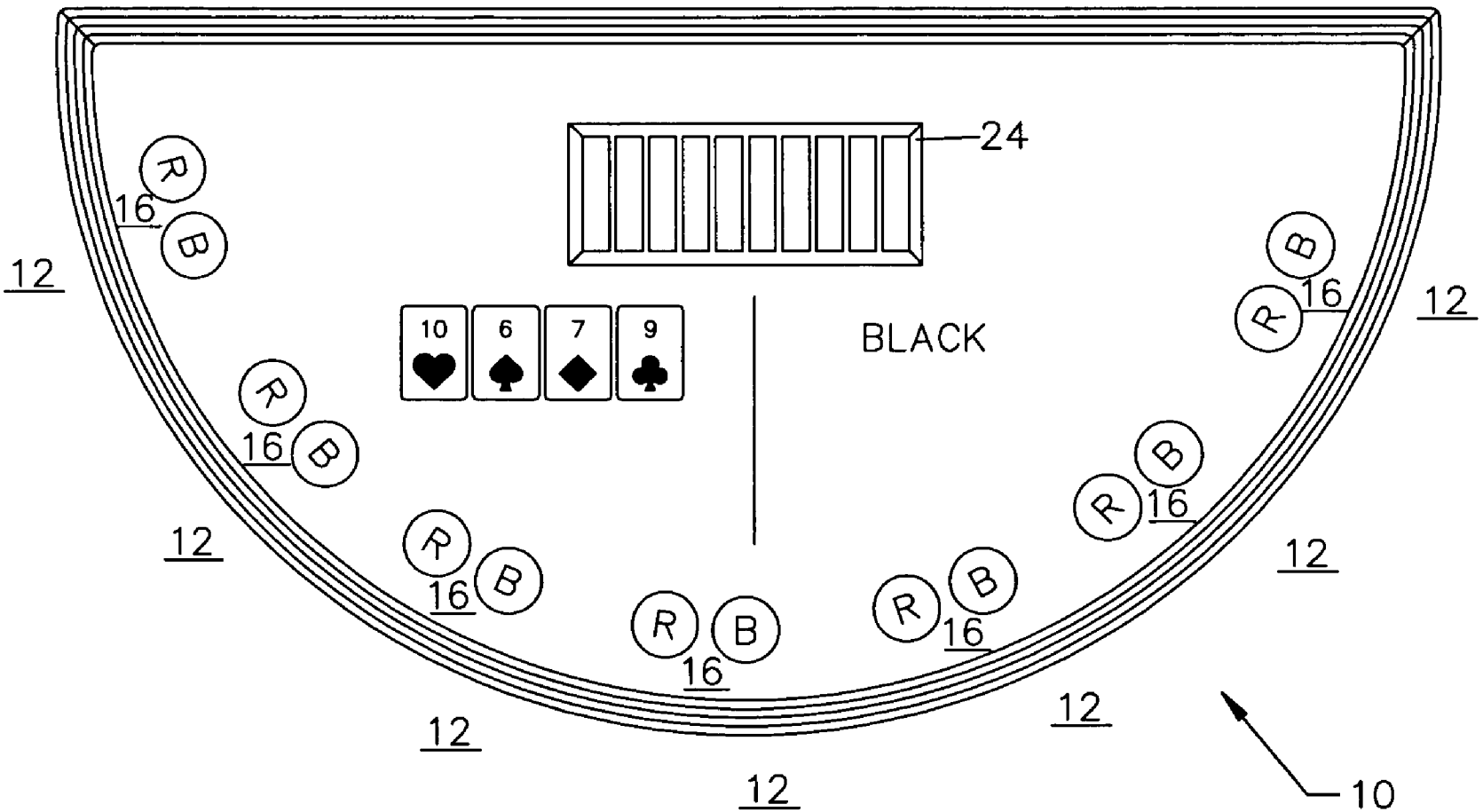
FIG. 2 shows a representative gaming table used in the method of play of the present invention after the deal of the first hand.

For example, as shown in FIG. 2, the first card dealt into the first hand is a Ten of Hearts (a red card), followed by the Six of Spades, the Seven of Diamonds and the Nine of Clubs. The hand count value for the first hand is 32. This is at least 31 and not more than 40, so no more cards are dealt to the first hand.

In a similar manner, the second hand, the BLACK hand, is dealt until the count value is at least 31 and not more than 40. However, the first card dealt to the second hand must be a black card. Any red card that comes off the deck before the first black card is discarded. After a black card is dealt into the second hand, cards are then dealt into the second hand regardless of suit.

Figure 3:
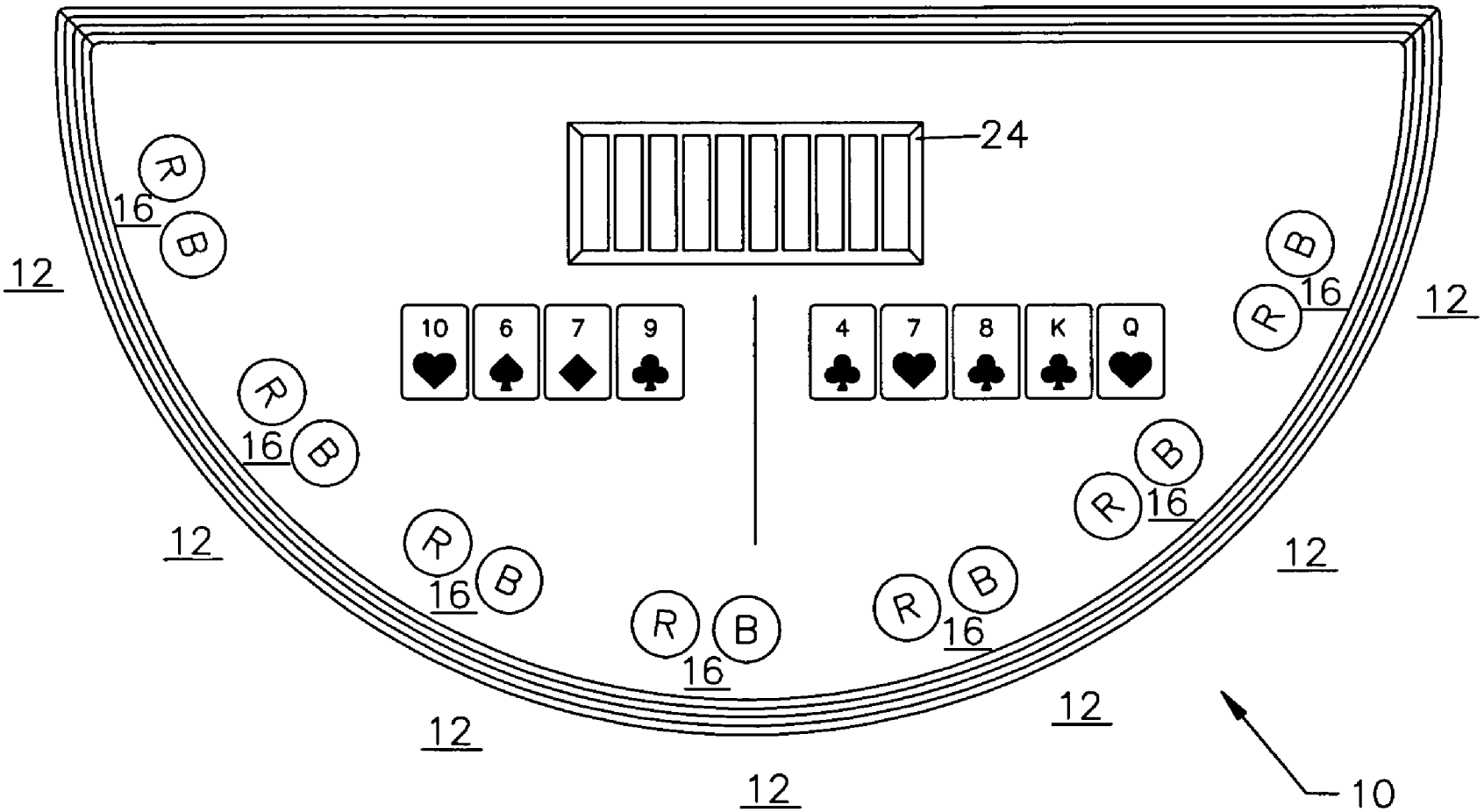
FIG. 3 shows a representative gaming table used in the method of play of the present invention after the deal of the second hand.

For example, as shown in FIG. 3, the first card dealt into the second BLACK hand is a Four of Clubs (a black card), followed by the Seven of Hearts, the Eight of Clubs, the King of Clubs and the Queen of Hearts. The hand count value for the second hand is 39. This is at least 31 and not more than 40, so no more cards are dealt to the second BLACK hand.

The hand having the higher count value wins—in the example shown in FIG. 3, the second BLACK hand is the winning hand. Each bettor who wagered on the second BLACK hand wins even money on the amount of his wager and is paid by the dealer. Each bettor who wagered on the first RED hand loses and his wager is collected by the dealer. Ties are pushes.

A house edge to the method of play may be provided by having the house win all RED and Black wagers whenever the first hand the second hand end in a tie with a hand count value of 31. Other methods of providing a house edge may be used.

Alternatively, the BLACK hand may be used as the first hand and the RED hand used as the second hand.

Alternatively, the hand having the lower count value may be declared as the winning hand.

The method of play may also be supplemented by offering the player side bet wagers. For example, the player may make a side bet on the poker hand ranking of the final RED hand or the final BLACK hand. The player would win that wager whenever the final hand ended with certain predetermined poker hand rankings such as Two Pair, Three-of-a-Kind, etc. A player could make this side bet wager by wagering on either the RED hand, the BLACK hand or both the RED hand and the BLACK hand.

Another side bet wager can be made on the number of cards that is dealt to the final hand. The more cards that are dealt to the final hand, the higher the odds payout can be made to a player who makes this side bet. A player could make this side bet on just the RED hand, just the BLACK hand or both the RED hand the BLACK hand. A player could make this side bet on just the winning final hand, just the losing final hand or both the winning final hand and the losing final hand.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) providing a physical standard deck of playing cards with each Ace having a count value of one, each face card having a count value of ten and each remaining card having a count value of its pip value;

b) dealing a first card of a predetermined color into the first hand and continuing to deal cards of any color into a first hand until the first hand has a count value of at least 31 and not more than 40;

c) dealing a first card of a color different from the predetermined color into the second hand and continuing to deal cards of any color into a second hand until the second hand has a count value of at least 31 and not more than 40; and d) determining the count value of the first hand and the count value of the second hand and declaring either the first hand or the second hand as a winning hand.

2. The method of claim 1 in which the winning hand has the higher count value.

3. The method of claim 1 in which the winning hand has the lower count value.

4. The method of claim 1 in which the predetermined color is RED.

5. The method of claim 1 in which the predetermined color is BLACK.

6. The method of claim 1 in which a bettor makes a wager on whether the first hand or the second hand will be the winning hand.

7. The method of claim 1 in which a bettor makes a wager on a poker hand ranking of the final hand.

8. The method of claim 1 in which a bettor makes a wager on the number of cards in a final hand.

* * * * *